United States Patent [19]

Hayashi et al.

[11] Patent Number: 5,009,094

[45] Date of Patent: Apr. 23, 1991

[54] METHOD OF ROLLING H-SHAPED STEELS

[75] Inventors: Hiroyuki Hayashi, Chiba; Tsuneo Seto, Kurashiki; Hironori Miura, Kurashiki; Yoji Fujimoto, Kurashiki, all of Japan

[73] Assignee: Kawasaki Steel Corporation, Kobe, Japan

[21] Appl. No.: 367,947

[22] Filed: Jun. 19, 1989

[30] Foreign Application Priority Data

| | | | |
|---|---|---|---|
| Jun. 27, 1988 | [JP] | Japan | 63-156828 |
| Jun. 29, 1988 | [JP] | Japan | 63-159518 |
| Sep. 20, 1988 | [JP] | Japan | 63-233393 |
| Feb. 10, 1989 | [JP] | Japan | 1-29995 |

[51] Int. Cl.[5] ..... B21B 13/08; B21B 41/06

[52] U.S. Cl. ..... 72/225; 72/229

[58] Field of Search ..... 72/224, 225, 229, 231, 72/234

[56] References Cited

FOREIGN PATENT DOCUMENTS

| | | | |
|---|---|---|---|
| 58-135705 | 8/1983 | Japan | 72/225 |
| 59-133902 | 8/1984 | Japan . | |
| 60-82201 | 5/1985 | Japan . | |
| 61-262404 | 1/1986 | Japan . | |
| 61-135403 | 6/1986 | Japan | 72/225 |
| 61-135404 | 6/1986 | Japan | 72/225 |
| 62-93008 | 4/1987 | Japan | 72/225 |
| 62-161403 | 7/1987 | Japan | 72/225 |
| 109 | of 1912 | United Kingdom | 72/225 |

*Primary Examiner*—E. Michael Combs

*Attorney, Agent, or Firm*—Oliff & Berridge

[57] ABSTRACT

H-shaped steel products having substantially a constant web height are efficiently manufactured from workpieces after breakdown rolling by using a particular universal rolling mill comprising a pair of width variable horizontal rolls and a pair of vertical rolls in rough universal rolling and/or finish universal rolling stages without arrangement of rolls in the same size series having different flange thicknesses.

3 Claims, 8 Drawing Sheets

$B_{wo} > B_{w1}$ $B_{wo} > B_{wi}$

METHOD OF ROLLING H-SHAPED STEELS

BACKGROUND OF THE INVENTION

1. Field of the Invention

This invention relates to a rolling method of H-shaped steels, and more particularly to a method wherein a web height of the wide flange beam is freely and precisely adjusted without requiring rearrangement of rolls to obtain an H-shaped steel having a constant outer width (web height).

2. Related Art Statement

In general, H-shaped steels are manufactured by hot rolling a starting workpiece 1, 2 or 3 as shown in FIGS. 2*a* to 2*c* through a line combining a breakdown rolling mill 6 with a rough universal rolling mill 7, an edger rolling mill 8 and a finish universal rolling mill 9 as shown in FIGS. 1*a* and 1*b*.

That is, each starting workpiece shown in FIGS. 2*a* to 2*c* (numeral 1 is a slab, numeral 2 a bloom, and numeral 3 a beam blank) is first roughened into a given shape in the breakdown rolling mill 6. As this mill 6 is used a 2-high breakdown rolling mill having upper and lower rolls engraved into an opening pass 4 or a closed pass 5 as shown in FIGS. 3*a* and 3*b*.

In brief, the workpiece is processed into a shape suitable for subsequent middle stage rolling by using various shaped calibers in the breakdown rolling mill 6 and successively rolling the workpiece through plural passes therein.

The roughened workpiece is subjected to a rolling at one pass or plural passes through the rough universal rolling mill 7 having one or more roll stands of a roll form as shown in FIG. 4*a* and the edger rolling mill 8 having one or more roll stands of a roll form as shown in FIG. 4*b*, which is then rolled into an H-shaped steel product at one pass through the finish universal rolling mill 9 having a roll form as shown in FIG. 4*c*. Therefore, when the product size is determined, the width of horizontal roll size of the finish universal rolling mill 9 as well as the width of horizontal roll of the former rolling mills are naturally determined.

That is, it is designed to make a size w1 in FIG. 3*a*, and sizes w2, w3 and w4 in FIGS. 4*a* to 4*c* substantially equal to each other.

Thus, the change of shape after the breakdown rolling is particularly restricted in the rolling of H-shaped steel. In case of rolling workpieces into H-shaped steels of particular size series (e.g. H600×300 or the like), therefore, a horizontal roll having a particular width is usually used.

However, the following problem is caused according to the conventional rolling method using the above horizontal rolls having such a particular width.

In H-shaped steels rolled by the horizontal roll of particular width, the web inner width is constant. When H-shaped steels of one size series are manufactured by using workpieces having a scattered flange thickness through the above horizontal roll, since the width of the horizontal roll is constant, the roll distance between the horizontal roll and the vertical roll is changed in accordance with the flange thickness. For example, in case of H-shaped steel having an ordinary size, the difference of flange thickness between maximum value and minimum value is about 16 mm at each flange portion, so that the web height is naturally changed within a range of about 32 mm.

Such a change of web height in the same size series is not avoided in the conventional rolling technique. When such a conventional rolling technique is applied to the manufacture of H-shaped steels for use in buildings, there is caused the following serious problem. That is, when a building beam is formed by joining plural H-shaped steels rolled in the same size series, since the web height is different even in the same size series as mentioned above, a large divergence at the joint face between the adjoining H shaped steels is caused, which comes into problem in the execution.

Further, when the structure of the building is designed in the usual manner, the size is successively determined from the outside toward the inside. On the other hand, the web height in the rolled H-shaped steels may be different though the web inner width is constant. The latter case considerably comes into problem when the severeness is required in the scramble to other size at the operating place.

Moreover, the rolled H-shaped steel has a problem in the size accuracy.

That is, in the rolling of H-shaped steel, a side face 11 of a horizontal roll 10 in the rough universal rolling mill 7 is worn as the rolling number increases to gradually reduce the roll width of the horizontal roll 10 as shown in FIG. 5. And also, a vertical roll 12 is worn together with the horizontal roll 10, but problems brought due to the wearing of the vertical roll are solved by merely adjusting the roll gap.

On the contrary, as to the wearing of the horizontal roll, when the rolling is carried out at a constant flange thickness t as shown in FIG. 6, not only the web inner width w5 but also the web height h reduce by the worn amount of the side face 11 of the horizontal roll 10. Therefore, the web height h is usually ensured by thickening the flange thickness t within a dimensional tolerance.

However, such a dimensional tolerance is as very small as ±3.0 mm when the web height is less than 400 mm, ±4.0 mm when the web height is not less than 400 mm but less than 600 mm, and ±5.0 mm when the web height is not less than 600 mm as defined according to JIS G3192. Since the web height h of the workpiece is dependent upon the size of the width of horizontal roll, the effective roll width of the horizontal roll usually used within the dimensional tolerance of the web height is restricted.

As mentioned above, when the rolling is continued by using the horizontal roll having a roll width reduced due to the wearing in the same size series, the flange thickness and hence the web height of the resulting product naturally change, so that it is required to replace the worn horizontal roll with new rolls. Furthermore, when the rolling is continued by using the new horizontal roll, the scattering of the flange thickness and hence web height in the products before and after the replacement of the new horizontal roll is naturally caused.

Since the above problem is caused when the web height in the H-shaped steel products obtained by the conventional rolling is not constant, H-shaped steels produced by welding plates so as to make the web height constant are used as a material for building. In the latter case, the production cost becomes naturally and undesirably high as compared with the case of the rolled H-shaped steel.

As the conventional technique, there are some techniques as disclosed, for example, in Japanese Patent laid open No. 59-133902, No. 60-82201, No. 61-262404 and the like.

In the technique disclosed in Japanese Patent laid open No. 59-133902, a width variable roll capable of changing a position in axial direction is incorporated into each of the rough universal rolling mill 7, the edger rolling mill 8 and the finish universal rolling mill 9 as shown in FIG. 1*a* to conduct partial rolling of web and rolling of flange end portion, whereby the rolling for difference web heights can be conducted by the same roll. Furthermore, in the technique disclosed in Japanese Patent laid open No. 60-82201, a sectional roll capable of changing a position in axial direction is incorporated into each of the primary rough universal rolling mill 7*a*, the edger rolling mill 8, the secondary rough rolling mill 7*b* and the finish rolling mill 9 as shown in FIG. 1*b*, whereby the rolling for different web heights and flange widths can be conducted by the same roll, or the above sectional roll is incorporated into each of the primary rough universal rolling mill 7*a*, the secondary rough universal rolling mill 7*b* and the finish rolling mill 9, whereby the rolling for different web heights can be conducted by the same rolling chance.

According to these techniques, since the web height can be varied within a large range, workpieces of several size series can be continuously rolled, so that the above techniques have many effects such as reduction of roll exchange number and the like as compared with the conventional rolling. However, when the web height of all products is made constant in the same size series, in spite that the adjusting amount of the distance between the sectional rolls is about 30 mm, a pair of horizontal rolls each comprised of two sectional rolls movable in the axial direction are arranged in each of the rough universal rolling mill, the edger rolling mill and the finish universal rolling mill, so that the equipment cost becomes very vast.

On the other hand, in the technique disclosed in Japanese Patent laid open No. 61-262404, when the workpiece after the breakdown rolling is hot rolled through rough rolling, finish rolling and the like into an H-shaped steel, it is first subjected to the rough rolling so as to form protrusions on both end portions of the web and then the finish rolling is carried out by using a pair of horizontal rolls each comprised of at least two sectional rolls capable of changing the position of the roll in the axial direction every rolling pass and properly changing the position of the sectional roll. In this method, however, the web protrusions having a thin thickness and a low temperature is partly rolled in the finish rolling step, so that there is still a problem of applying an over load to the sectional roll due to the increase of the roll surface pressure.

SUMMARY OF THE INVENTION

It is, therefore, an object of the invention to provide a rolling method wherein H-shaped steels having an approximately constant web height can efficiently be manufactured without increasing the production cost and applying an excessive load to the rolls even when the workpieces have different flange thicknesses in the same size series.

According to the invention, there is the provision of a method of manufacturing H-shaped steels by successively subjecting a workpiece comprising a web portion and a pair of flange portions after breakdown rolling to rough universal rolling and finish universal rolling, characterized in that a web inner width of said workpiece is reduced at least once through a universal rolling mill comprising a pair of upper and lower width variable horizontal rolls and a pair of left and right vertical rolls, which is arranged in said rough universal rolling and/or said finish universal rolling and set a roll width of each of said width variable horizontal rolls to a value smaller than a web inner width of the workpiece rolled at forward pass.

BRIEF DESCRIPTION OF THE DRAWINGS

The invention will be described with reference to the accompanying drawings, wherein.

DESCRIPTION OF THE PREFERRED EMBODIMENTS

Figure 1A:
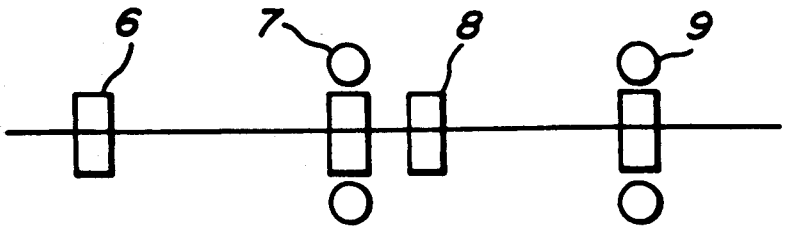
FIG 1a PRIOR ART
FIGS. 1*a* and 1*b* are schematic views illustrating conventional rolling process for H-shaped steel, respectively.
Figure 1B:
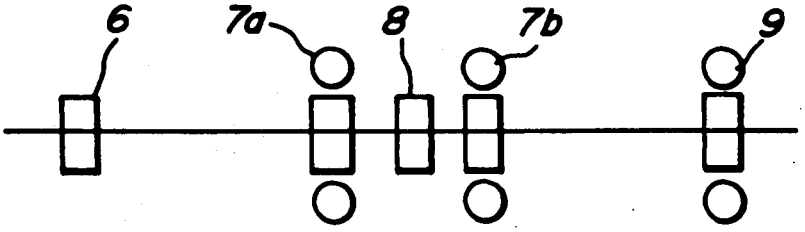
FIG 1b PRIOR ART
Figure 2A:
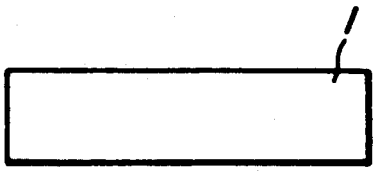
FIG 2a PRIOR ART
FIGS. 2*a* to 2*c* are schematically section views of workpieces to be rolled into H-shaped steel, respectively.
Figure 2B:
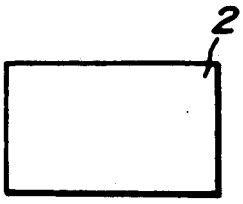
FIG 2b PRIOR ART
Figure 2C:
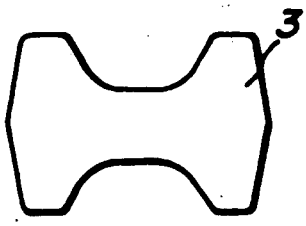
FIG 2c PRIOR ART
Figure 3A:
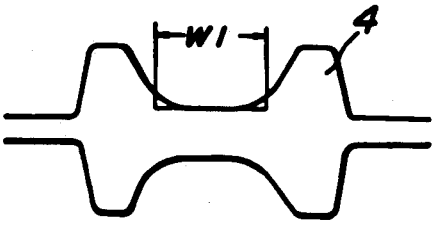
FIG 3a PRIOR ART
FIGS. 3*a* and 3*b* are schematic views of caliber form in rolling rolls used in breakdown rolling, respectively.
Figure 3B:
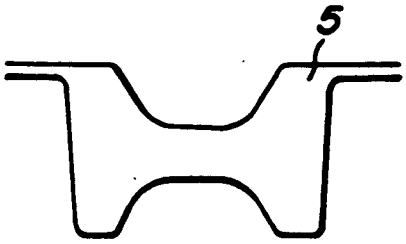
FIG 3b PRIOR ART
Figure 4A:
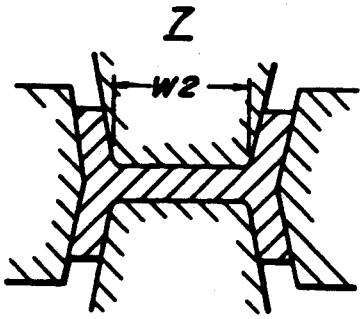
FIG 4a PRIOR ART
FIGS. 4*a* to 4*c* are diagrammatical views showing states at rough universal rolling, edger rolling and finish universal rolling, respectively.
Figure 4B:
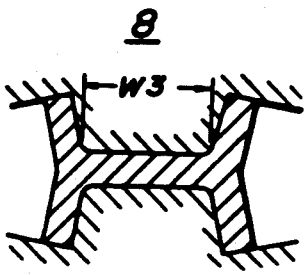
FIG 4b PRIOR ART
Figure 4C:
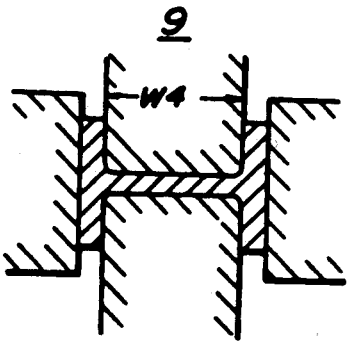
FIG 4c PRIOR ART
Figure 5:
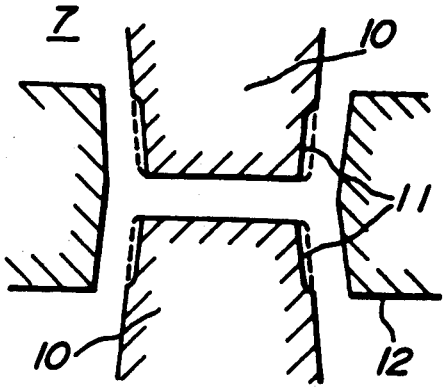
FIG 5 PRIOR ART
FIG. 5 is a diagrammatical view showing a worn state of horizontal rolls.
Figure 6:
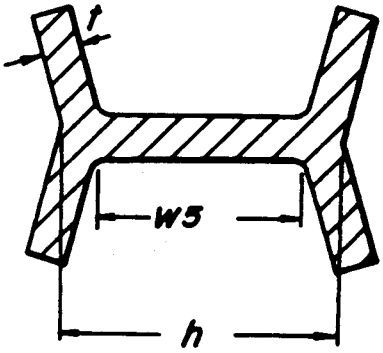
FIG 6 PRIOR ART
FIG. 6 is a diagrammatical view showing a main size of a rough H-shaped steel.
Figure 7:
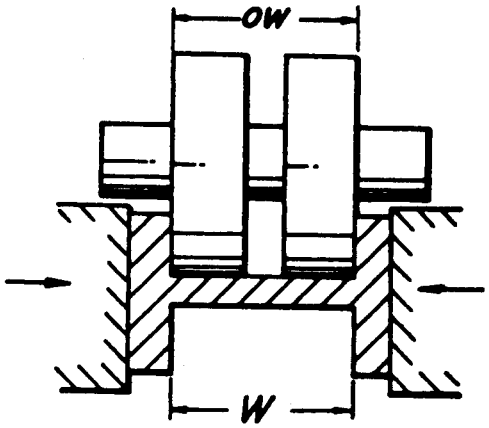
FIG. 7 is a diagrammatical view of a width variable rolling roll used in the invention.

In order to solve the problems in the conventional partial rolling methods as previously mentioned, according to a first aspect of the invention, the workpiece is subjected to usual rolling up to a rough universal rolling stage, and then subjected to a finish rolling through a universal rolling mill comprising a pair of width variable horizontal rolls and a pair of vertical rolls, wherein an outer width of the horizontal roll pair is adjusted to a web inner width W of an objective H-shaped steel as shown in FIG. 7, whereby the setting up of angle of the flange portion, reduction of height of the web portion and reduction of thickness of the flange portion in the rough rolled workpiece are conducted to produce H-shaped steels having a constant web height.

In the first invention, it is possible to uniformize the reduction of each portion in the section of H-shaped steel, so that there is an advantage that remarkable increase of roll surface pressure due to locally forced rolling, which is a serious problem in the conventional partial rolling method, is not caused.

Figure 8A:
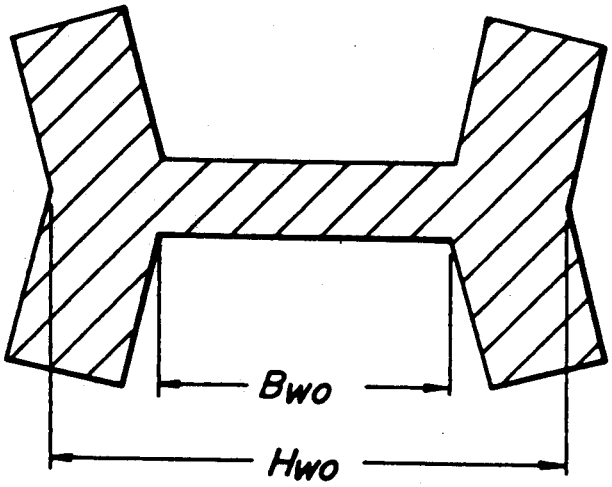
FIGS. 8*a* and 8*b* are schematically sectional views of H-shaped steel before and after finish universal rollings according to the first invention, respectively.
Figure 8B:
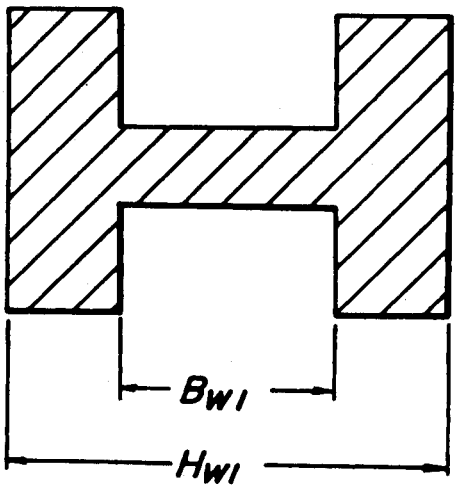

That is, in the rolling for H-shaped steel, for example, when the workpiece (web height: $H_{W0}$) after the rough universal rolling as shown in FIG. 8a is subjected to a finish universal rolling to produce an H-shaped steel having a web height $H_{W1}$ as shown in FIG. 8b, the rolling reduction in a direction of web height ($\gamma_{HW}$) is represented by the following equation (1):

$$\gamma_{HW}=1-H_{W1}/H_{WO} \quad (1)$$

Furthermore, the outer width ($B_{W1}$) of the horizontal roll in the finish universal rolling mill for reducing the flange thickness at the same rolling reduction as mentioned above is represented by the following equation (2):

$$B_{W1}=H_{W1}/(1-\gamma_{HW})\cdot T_{f1}/T_{f0}-2T_{f1}\ _{mm} \quad (2)$$

wherein $H_W$ is a web height (mm), $B_W$ is an inner width of web (mm), $T_f$ is a thickness of flange (mm), suffix 0 is a case before finish rolling and suffix 1 is a case after finish rolling.

When the objective web height $H_{W1}$ and flange thickness $T_{f1}$ are given and the flange thickness $T_{f0}$ after the rough universal rolling is determined, the outer width $B_{W1}$ of the horizontal roll pair in the finish universal rolling mill is set according to the equation (2), whereby the rough rolled workpiece is rolled at an approximately uniform rolling reduction in all section. Therefore, the invention is made possible to conduct stable rolling without the increase of local surface pressure being a problem in the conventional rolling. Even in the case of usual rolling, there is a certain dimensional tolerance in the roll width of the horizontal roll pair in both rough and finish universal rolling mills, so that the web inner width may be reduced by about 2~3 mm. However, according to the invention, the reduction of the web inner width as mentioned above is positively carried out without the rearrangement of rolls, so that the invention is particularly suitable for reducing the web inner width to not less than 5 mm.

When the reduction of web inner width is carried out in the finish universal rolling mill according to the first invention, there is a fear of causing the breakage of fillet portion, the buckling of the web portion and the like. Such a fear can be avoided by disposing a web guide at an entrance side of the finish universal rolling mill or enhancing a guiding accuracy of the rough rolled workpiece, whereby the H-shaped steels having a constant web height can be surely produced by the reduction of the web inner width.

Particularly, the buckling of the web portion can be prevented by a combination of buckling prevention through web guide and the reduction through horizontal roll. However, when the web thickness is too thin, the occurrence of shape defect such as displacement of web center after the rolling (hereinafter referred to as center displacement) and the like may come into problem, so that it is important to determine critical condition causing no shape defect. In this connection, the inventors have made various studies and found that the reduction limit of the web inner width has a relation shown in FIG. 9 in the first invention.

Figure 9:
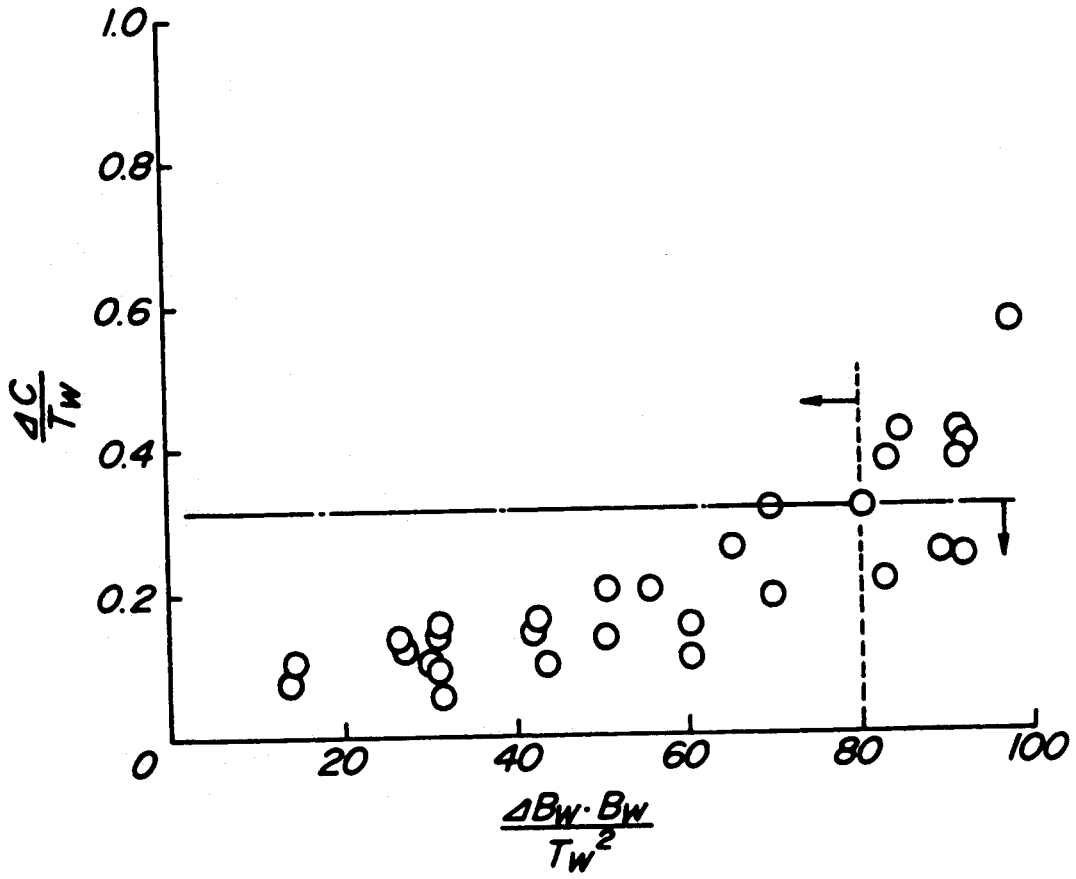
FIG. 9 is a graph showing a reduction limit of web inner width per one pass.

That is, FIG. 9 shows results on the change of central displacement after the rolling when the workpieces are rolled so as to reduce the web height to a given constant value at a web thickness of 6~16 mm to obtain H-shaped steels having various nominal product sizes, wherein an abscissa is $\Delta B_W \cdot B_W/T_W^2$ and an ordinate is $\Delta C/T_W$ when the web thickness before the rolling is $T_W$, the web inner width is $B_W$, the amount of inner width reduced is $\Delta B_W$ and the amount of central displacement increased is $\Delta C$. As shown in FIG. 9, when the value of the abscissa becomes large, i.e. when the amount of inner width reduced is large to the value of the web thickness and the web inner width is large, the value of central displacement exponentially increases, which indicates that the reduction at one pass is critical.

The reduction of the web inner width should be carried out within an acceptable range of central displacement in order to prevent the degradation of the shape in the finish universal rolling mill. The central displacement is aimed to be ±2 mm according to JIS G3192 in case of H-shaped steel for building, which corresponds to 0.33 in the ordinate considering that the web thickness in the existing rolling method is 6 mm at most and 80 in the abscissa. This is an indicate showing the critical value of the reduced amount of web inner width. As seen from the results of FIG. 9 and the above fact, the amount of web inner width reduced ($B_W$) per one pass is necessary to be not more than $\Delta B_{max}$ represented by the following equation (3):

$$\Delta B_{max}=80\cdot T_W^2 B_W \quad (3)$$

Particularly, if the amount of web inner width reduced exceeds $80\cdot T_W^2/B_W$, it is effective to render the pass number for the reduction of web inner width into not less than 2 passes in order to prevent the shape degradation.

Further, the central displacement is mainly due to the fact that the center in widthwise direction of the flange portion is not exactly guided at a center position between the upper and lower horizontal rolls. As a result, when the reduced amount of web inner width exceeds the above optimum range, the shifting of the position in widthwise direction of the flange portion is promoted by the reduction in a direction of web height, and the fillet portion is broken in an extreme case.

In order to prevent such a problem, the inventors have made further studies and found that it is very effective to mechanically restrain the end portions in widthwise direction of the flange portion to forcedly guide the central position in widthwise direction of the flange portion at a center of roll gap between the upper and lower horizontal rolls.

Figure 10A:
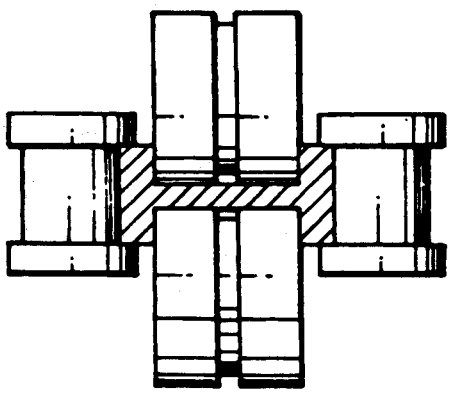
FIGS. 10*a* to 10*c* are views showing a restraining means for flange portion according to the invention, respectively.
Figure 10B:
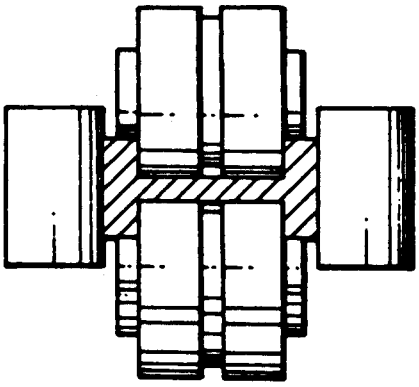
Figure 10C:
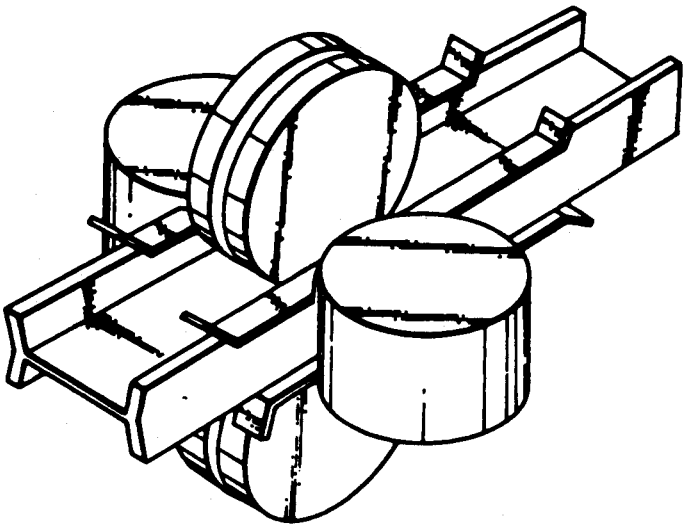

As a means for restraining the end portion in widthwise direction of the flange portion, it is considered to use a pair of grooved vertical rolls, a pair of grooved horizontal rolls, two pairs of throughout guide members located in a roll distance between the vertical rolls and the like as shown in FIGS. 10a to 10c. All of these means are effective to restrain the end portion in widthwise direction of the flange portion, but the use of the through-out guide member as shown in FIG. 10c is particularly effective for adapting to H-shaped steels of various sizes, wherein the guide position is lifted up and down in accordance with the size of the flange width. In this connection, the inventors have made studies with respect to the reduction limit at such a restrained state of the end portion in widthwise direction of the flange portion and found that a relation as shown in FIG. 11 is existent in such a reduction limit.

Figure 11:
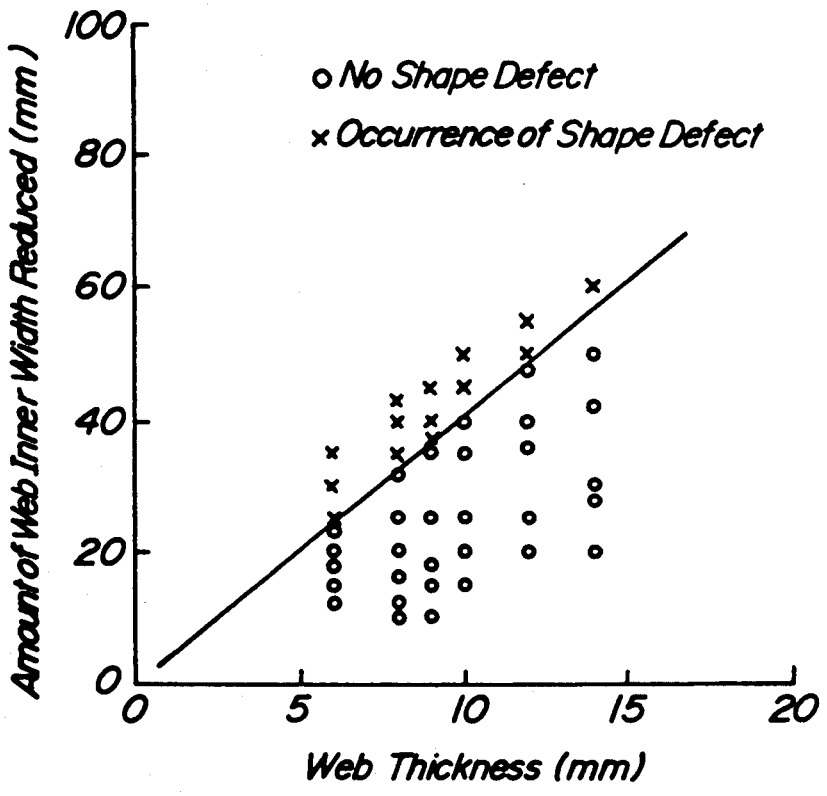
FIG. 11 is a graph showing a reduction limit of web inner width when using the restraining means for flange according to the invention.

FIG. 11 shows the limit of reduced amount of web inner width per one pass to the web thickness for causing no occurrence of shape defect. As seen from FIG. 11, when the restraining of the flange end portion is carried out by using the through-out guide member, the occurrence of shape defect is prevented by limiting the amount of web inner width reduced per one pass to not more than 4 times of the web thickness irrespective of the web height. If the reduced amount of web inner width exceeds 4 times of the web thickness, it is effective to render the pass number into not less than 2 passes for preventing the occurrence of shape defect.

As mentioned above, the first invention is a method of conducting reduction adjustment of web inner width, reduction of web and flange thicknesses and angle setting up of flange in the finish universal rolling mill.

A greater part of the object for producing H-shaped steels having a constant web height can be achieved by the first invention. However, when the adjusting amount of the web inner width is large, it is necessary to conduct the finish rolling at not less than 2 passes as mentioned above, so that there may be caused a problem in the product quality because the angle setting up of the flange portion is completed at the first pass of the finish rolling.

From this point, a second aspect of the invention lies in that the reduction adjustment of the web inner width is carried out at a rough universal rolling stage prior to the finish rolling through the universal rolling mill. In the second invention, the reduction of the web inner width is completed at the rough universal rolling stage, so that it is enough to conduct only the angle setting up of the flange portion and the reduction of web and flange thicknesses at the finish universal rolling stage, so that such a second invention has an advantage that H-shaped steels having a constant web height can be produced in a higher size accuracy as compared with the first invention.

According to the second invention, a universal rolling mill comprising a pair of upper and lower width variable horizontal rolls and a pair of left and right vertical rolls is disposed at the rough universal rolling stage, and the workpiece after the breakdown rolling is passed therethrough at least once to conduct the reduction adjustment of web inner width as well as the reduction of web and flange thicknesses, and then the angle setting up of flange is carried out in a finish universal rolling mill comprising the same width variable horizontal rolls as mentioned above. In the second invention, therefore, H-shaped steels having different flange thicknesses and a constant web height can be produced in the same size series rolling. Particularly, according to the second invention, the reduction rolling and the reduction of web and flange thicknesses are conducted at the rough universal rolling before the finish universal rolling, so that the rolling reduction can be uniformized in each sectional portion of the workpiece and also there is not local increase of surface pressure.

Figure 12:
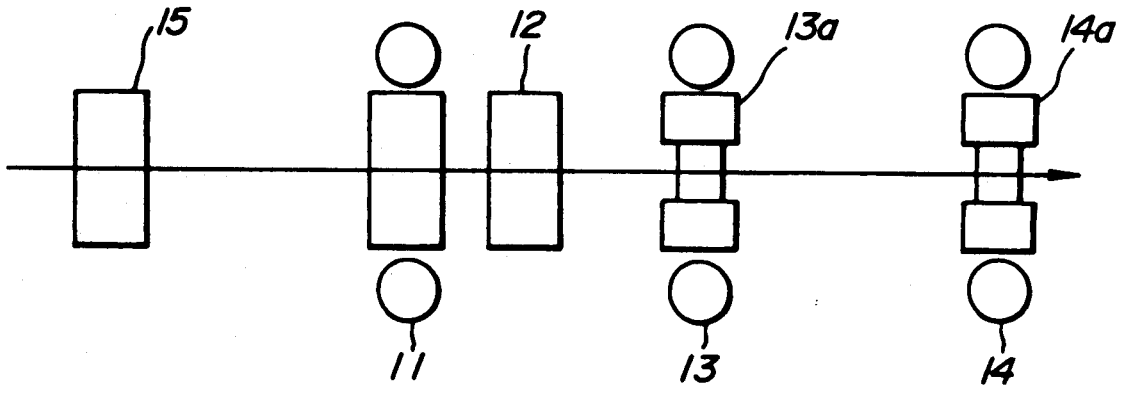
FIG. 12 is a schematic view illustrating an arrangement of rolling mills suitable for carrying out the second invention.

FIG. 12 schematically shows an arrangement of rolling mills suitable for carrying out the second invention, wherein numeral 11 is a rough universal rolling mill, numeral 12 an edger rolling mill, numeral 13 a universal rolling mill having a pair of width variable horizontal rolls 13*a* for reduction of web thickness according to the invention, numeral 14 a finish universal rolling mill having a pair of width variable horizontal rolls 14*a*. Furthermore, numeral 15 is a breakdown rolling mill.

The workpiece roughened by the breakdown rolling mill is repeatedly rolled through the rough universal rolling mill 11 and the edger rolling mill 12 till each of the web thickness, flange thickness and flange width is rendered into an objective value.

Then, the workpiece after the rough universal rolling is rolled through the universal rolling mill 13 defined in the invention at least once so as to adjust and reduce the web inner width to a given value, and further subjected to a finish rolling in the universal rolling mill 14 while conducting the angle setting up of the flange.

Figure 13A:
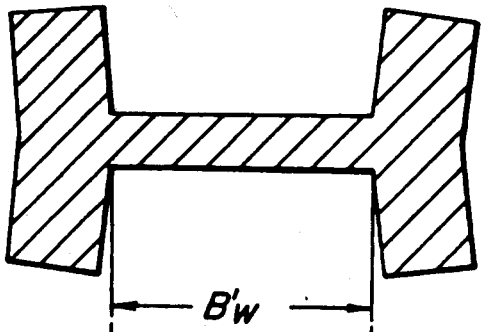
FIGS. 13*a* to 13*c* are schematically sectional views of H-shaped steel at each rolling stage according to the second invention.
Figure 13B:
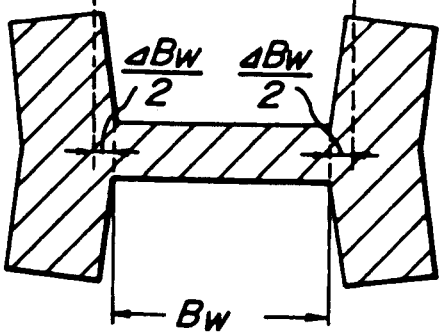
Figure 13C:
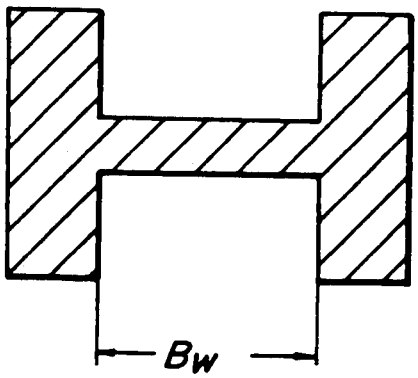

In the second invention, the universal rolling mill 13 capable of adjusting the reduction of the web inner width is desirable to be arranged near to the rough universal rolling mill. However, there is no interference even when a distance not interfering with the subsequent workpiece is existent between both the mills. Furthermore, the rolling mill 13 may be arranged at any position capable of conducting the reduction of the web inner width before the finish universal rolling. FIGS. 13*a* to 13*c* show sectional shapes of the workpiece rolled at the rolling mills 11, 13 and 14, respectively. The workpiece after the rough universal rolling has a web inner width $B'_W$ as shown in FIG. 13*a*, while the workpiece passed through the universal rolling mill 13 has a web inner width $B_W$ as shown in FIG. 13*b*, which is smaller than $B'_W$ and corresponds to a given web inner width of H-shaped steel obtained after the finish universal rolling as shown in FIG. 13*c*. In this case, if the amount of web inner width to be reduced ($\Delta B_W$) is small, it is adjusted in the universal rolling mill 13 at once, while when the amount is large, it is adjusted by repeating the rolling in the universal rolling mill 13.

As mentioned above, according to the second invention, the rolling for reducing the web inner width is carried out at such a stage that the inner face of the flange portion has a draft angle as compared with the finish rolling stage conducting the reduction adjustment of the web inner width, so that the large adjusting amount for the reduction of the web inner width is obtained. Further, in the second invention, the rolling function is divided in the rough universal rolling and the finish universal rolling, so that the size accuracy can further be improved.

A third aspect of the invention lies in a combination of the first invention and the second invention. In this case, the effect aiming at the invention can further be enhanced.

The following examples are given in illustration of the invention and are not intended as limitations thereof.

EXAMPLE 1

This example shows the production of H-shaped steels having a typical nominal size of H450×200.

Workpieces having web thickness and flange thickness of 8 mm×14 mm, 9 mm×16 mm, 10 mm×19 mm, 11 mm×22 mm and 14 mm×28 mm were rolled to given thicknesses in the rough universal rolling, and then subjected to a finish rolling in a universal rolling mill comprising a pair of width variable horizontal rolls and a pair of vertical rolls, wherein the distance between the vertical rolls was set to match the web height of these workpieces with a web height of H-shaped steel having a smallest flange thickness of H450×200×8×14 and the outer width of the horizontal roll was adjusted to a value satisfying a reduction of flange thickness corresponding to a reduction in a direction of web height as shown in the following Table 1. Since the vertical rolls in each universal rolling mill were usually no-driving type, poor contact was caused at the top of the workpiece in case of H450×200×14×28 having a large reduction amount in web height direction, so that the workpiece was pushed by means of an auxiliary pushing member located at the entrance side of the mill for obtaining sufficient contacting.

On the other hand, the usual horizontal roll was used in the rough universal rolling mill. After the finish universal rolling, the web height was measured to obtain results as shown in Table 1.

TABLE 1

| Web thickness × flange thickness (mm) | Web height of workpiece after rough universal rolling (mm) | Outer width of horizontal roll in finish universal rolling mill (mm) | Web height of H-shaped steel after cooling (mm) |
|---|---|---|---|
| 14 × 28 | 484.3 | 394 | 450.5 |
| 11 × 22 | 470.0 | 406 | 450.5 |
| 10 × 19 | 463.1 | 412 | 450.4 |
| 9 × 16 | 456.5 | 418 | 450.2 |
| 8 × 14 | 453.5 | 422 | 450.0 |

EXAMPLE 2

In order to produce H-shaped steels having a nominal size of H500×200, workpieces having web thickness and flange thickness of 6 mm×9 mm, 9 mm×12 mm, 9 mm×16 mm, 12 mm×16 mm and 12 mm×22 mm were rolled to given thicknesses in the rough universal rolling mill provided with a horizontal roll having a roll width of 482 mm, and then subjected to a finish rolling in a universal rolling mill comprising a pair of width variable horizontal rolls and a pair of vertical rolls, wherein the distance between the vertical rolls was set to match the web height of these workpieces with a web height of H-shaped steel having a smallest flange thickness of H500×200×6×9 and the roll width of the horizontal roll was adjusted in accordance with the flange thickness of each workpiece. The pass number for the reduction of web inner width, the reduction limit per one pass, the reduction amount and the center displacement amount at the central portion of the shaped product in longitudinal direction were measured to obtain results as shown in the following Table 2.

Moreover, the workpieces of 9 mm×16 mm and 12 mm×22 mm were rolled at two passes because the reduction amount per one pass exceeded the reduction limit defined in the invention. For the comparison, the workpieces of 9 mm×16 mm and 12 mm×22 mm were rolled at one pass under the reduction amount exceeding the reduction limit.

TABLE 2

| Run No. | Web thickness × flange thickness (mm) | Reduction limit per one pass (mm) | Pass number | Reduction amount | Displacement of web center after rolling (mm) |
|---|---|---|---|---|---|
| 1 | 6 × 9 | 5.98 | 1 | 0 | 0.5 |
| 2 | 9 × 12 | 13.44 | 1 | 6 | 0.8 |
| 3 | 9 × 16 | 13.44 | 1 | 14 | 2.3 |
| | | | 2 | 7 + 7 | 1.2 |
| 4 | 12 × 16 | 23.90 | 1 | 14 | 1.8 |
| 5 | 12 × 22 | 23.90 | 1 | 26 | 5.7 |
| | | | 2 | 13 + 13 | 1.6 |

As seen from Table 2, when a certain restriction is applied to the reduction amount of web inner width per one pass, the effect of preventing the occurrence of shape defect is conspicuous, and the displacement of web center is very small.

EXAMPLE 3

In order to produce H-shaped steels having a nominal size of H500×200, workpieces having web thickness and flange thickness of 6 mm×9 mm, 9 mm×12 mm, 9 mm×16 mm, 12 mm×16 mm, 12 mm×22 mm and 12 mm×24 mm were rolled to given thicknesses in the rough universal rolling mill provided with a horizontal roll having a roll width of 482 mm, and then subjected to a finish rolling in a universal rolling mill comprising a pair of width variable horizontal rolls and a pair of vertical rolls, wherein the distance between the vertical rolls was set to match the web height of these workpieces with a web height of H-shaped steel having the smallest flange thickness of H500×200×6×9 and the outer width of the horizontal roll was adjusted in accordance with the flange thickness of each workpiece while restraining the end portions of the flange with two pairs of through-out guide members as shown in FIG. 10c to locate the center in widthwise direction of the flange at a center between the horizontal rolls. In this case, the pass number was 1.

The rolling results are shown in the following Table 3. For the comparison, the rolling results when not using the flange restraining means are also shown in Table 3. Further, in order to confirm the occurrence of shape defect when the reduction of web inner width is carried out at a value exceeding the reduction limit, the rolling results when the workpieces having the thinnest web thickness (6 mm×9 mm) and the thickest web thickness (12 mm×25 mm) were subjected to reduction of web inner width exceeding 4 times of web thickness are also shown in Table 3.

TABLE 3

| Web thickness $T_w$ (mm) | Flange thickness $T_f$ (mm) | Reduction amount of web inner width $\Delta B_w$ (mm) | $\Delta B_w/T_w$ | Flange restraining means | Shape defect |
|---|---|---|---|---|---|
| 6 | 9 | 0 | 0 | — | o |
| 9 | 12 | 6 | 0.67 | absence | o |
| | | | | presence | o |
| 9 | 16 | 14 | 1.56 | absence | x |
| | | | | presence | o |
| 12 | 16 | 14 | 1.17 | absence | o |
| | | | | presence | o |
| 12 | 22 | 26 | 2.17 | absence | x |
| | | | | presence | o |
| 12 | 25 | 32 | 2.67 | absence | x |
| | | | | presence | o |
| 6 | 9 | 25 | 4.17 | presence | x |
| 12 | 25 | 50 | 4.17 | presence | x |

(Note)
o: no shape defect
×: occurrence of shape defect

As seen from Table 3, when the flange restraining means is not used, the shape defect is caused in the workpieces of 9 mm×16 mm, 12 mm×22 mm and 12 mm×25 mm, while when the flange restraining means is used, there is no occurrence of shape defect even in these workpieces, from which the effect of the invention is clear.

Furthermore, when the rolling is carried out at the reduction of web inner width exceeding 4 times of the web thickness, even if the flange restraining means is used, the shape defect is caused, from which it is confirmed that the rolling should be carried out at the reduction amount not exceeding 4 times of the web thickness.

EXAMPLE 4

In this example, H-shaped steels having a nominal size of H600×200 were manufactured by using workpieces having flange thickness and web thickness of 8 mm×12 mm, 10 mm×16 mm, 11 mm×19 mm, 12 mm×22 mm and 14 mm×28 mm through the arrangement of rolling mills shown in FIG. 12.

In the universal rolling mill 13, when the ratio $\delta$ of reduction amount $\Delta B_W$ of web inner width in the workpiece to web thickness $T_{W0}$ before the rolling was less than 1.0, one pass rolling was carried out, while when $\delta$ was not less than 1.0 but less than 2.0, two pass rolling was carried out, and when $\delta$ was not less than 2.0, three pass rolling was carried out. Furthermore, the web height of H-shaped steel was adjusted to match with the web height of the workpiece having a thinnest flange thickness of 8 mm×12 mm. The sizes of each portion in the resulting H-shaped steel products were measured to obtain results as shown in the following Table 4.

TABLE 4

| Work piece size (mm) | Product size: Web thickness (mm) | Flange thickness (mm) | Web height (mm) |
|---|---|---|---|
| 8 × 12 | 7.95 | 11.98 | 599.8 |
| 10 × 16 | 9.89 | 15.95 | 599.9 |
| 11 × 19 | 10.92 | 18.97 | 600.1 |
| 12 × 22 | 11.95 | 21.89 | 600.3 |
| 14 × 28 | 13.85 | 28.01 | 600.5 |

EXAMPLE 5

In this example, H-shaped steels having a nominal size of H400×200 were manufactured from workpieces having a size of 478 mm×205 mm×14 mm×28 mm after the breakdown rolling under the following conditions by using the arrangement of rolling mills as shown in FIG. 12, wherein the same rolling mill as in the universal rolling mill 13 was applied to the finish universal rolling mill 14. That is, the workpiece passed through the rough universal rolling mill 11 was rolled at a reduction amount in a web widthwise direction of 45 mm in the last rough universal rolling mill 13 and further at a reduction amount in the web widthwise direction of 33 mm in the finish universal rolling mill 14. Moreover, the roll width of the horizontal roll was 425 mm in the rough universal rolling mill 12, 380 mm in the universal rolling mill 13, and 347 mm in the finish universal rolling mill 14, respectively.

As a result, even when the total reduction amount in the universal rolling mills 13 and 14 was 78 mm, there was caused no breakage in the vicinity of fillet portion or the like, so that the reduction limit per one pass (40 mm) could be highly enlarged.

Here, the reason why the first reduction amount is larger than the second reduction amount is based on the fact that the workpiece is easily deformed at the first reduction rolling stage to cause no occurrence of shape defect because the web thickness is thick and the temperature is high.

Moreover, even when the reduction amount in the web widthwise direction is not less than 100 mm, desirable H-shaped steel may easily be manufactured by using plural universal rolling mills 13.

As mentioned above, according to the invention, the reduction of web inner width is positively carried out in a particular universal rolling mill provided with a width variable horizontal roll at rough and/or finish universal rolling stages, so that H shaped steels having substantially a constant web height can efficiently be manufactured without rearrangement of rolls in the same size series even when the flange thickness is different.

What is claimed is:

1. A method of manufacturing H-shaped steels comprising the steps of:

subjecting a workpiece to break down rolling by passing the workpiece at least once through a break down rolling mill, the work piece after break down rolling composed of a web portion and a pair of flange portions;

subjecting the workpiece to rough universal rolling by passing the workpiece at least once through a rough universal rolling mill;

subjecting the workpiece to finish universal rolling by passing the workpiece at least once through a finish universal rolling mill;

subjecting said workpiece to web-reduction universal rolling in any position ranging from final pass of said rough universal rolling to said finish universal rolling, wherein the inner width of said web of said workpiece is decreased by an amount within a range not exceeding $80 \times T_W^2/B_W$, wherein $T_W$ is the thickness of said web portion of said workpiece and $B_W$ is the inner width of said web portion of said workpiece;

wherein concurrently with said reduction of said web inner width, the thickness of said flange of said workpiece is reduced;

wherein said step of web-reduction universal rolling at any position ranging from final pass of said rough universal rolling to said finish universal rolling comprises the step of passing the workpiece at least once through a universal rolling mill, where the rolling mill comprises a pair of upper and lower width variable horizontal rolls and a pair of left and right vertical rolls, and wherein the roll width of each of said width variable horizontal rolls is set to a smaller length than said inner width of the web of said workpiece.

2. The method according to claim 1, wherein the step of subjecting the workpiece to web reduction universal rolling comprises reducing said inner width of said web, and restraining at least one end portion of said flange of said web in width-wise direction with a flange restraining means, and wherein the reduction of said inner width of said web is of amount not more than four times the thickness of said web prior to said step of subjecting the workpiece to web reduction universal rolling.

3. The method according to claim 2, wherein in said step of subjecting said workpiece to web reduction universal rolling, said flange restraining means is a through-out guide member that is movable in accordance with the size of the flange width.

* * * * *